US005898262A

United States Patent [19]

Kim et al.

[11] Patent Number: 5,898,262

[45] Date of Patent: Apr. 27, 1999

[54] CATHODE STRUCTURE AND ELECTRON GUN FOR CATHODE RAY TUBE USING THE SAME

[75] Inventors: Chang-seob Kim, Suwon; Bong-uk Jeong, Seoul, both of Rep. of Korea

[73] Assignee: Samsung Display Devices Co., Ltd., Kyungki-do, Rep. of Korea

[21] Appl. No.: 08/889,509

[22] Filed: Jul. 8, 1997

[30] Foreign Application Priority Data

Aug. 7, 1996 [KR] Rep. of Korea ..... 96-27524
Aug. 7, 1996 [KR] Rep. of Korea ..... 96-27528

[51] Int. Cl.[6] ..... H01J 1/14

[52] U.S. Cl. ..... 313/446; 313/270; 313/346 R

[58] Field of Search ..... 313/446, 447, 313/451, 452, 460, 497, 270, 310, 337, 346 R, 409

[56] References Cited

U.S. PATENT DOCUMENTS 4,965,486 10/1990 Kolpin ..... 313/346

*Primary Examiner*—Vip Patel

*Attorney, Agent, or Firm*—Lowe Hauptman Gopstein Gilman & Berner

[57] ABSTRACT

In an electron gun for a color cathode ray tube including a cathode structure having three electrodes, a control electrode and a screen electrode, and a plurality of focus electrodes and last accelerating electrodes for forming electron lenses, the cathode structure includes a rimmed electrode member, an insulating member inserted into the electrode member and having an indentation formed on the upper surface thereof, a field emission array cell having a base member which is inserted into the indentation, and a plurality of supporting members installed at the insulating member for pressing down on the upper surface of the edge of the field emission array cell which is inserted into the indentation toward the upper surface of the insulating member. Thus, the strength of attachment between the insulating member and a field emission device is improved.

10 Claims, 4 Drawing Sheets

CATHODE STRUCTURE AND ELECTRON GUN FOR CATHODE RAY TUBE USING THE SAME

BACKGROUND OF THE INVENTION

The present invention relates to an electron gun for a cathode ray tube, and more particularly, to a cathode structure in which a combining structure of an electron emission array cell and a supporter for supporting the same is improved, and an electron gun for a cathode ray tube using the cathode structure.

A typical cathode ray tube, as shown in FIG. 1, includes a panel 10 on which a fluorescent film is formed, a funnel 20 sealed with the panel 10, an electron gun 30 installed at a neck portion 21 of the funnel 20, and a deflecting yoke 23 installed at a cone portion 22 of the funnel 20. In the cathode ray tube structured as above, an electron beam emitted from the electron gun 30 is deflected by the deflecting yoke 23 and scanned onto the fluorescent film 11 to form an image by exciting the fluorescent film 11.

FIG. 2 shows an example of an electron gun for emitting thermions which is installed at the neck portion 21 of the funnel 20.

The electron gun is comprised of a cathode structure 31 comprised of three electrodes, a control electrode 32 and a screen electrode 33, a focus electrode 34 and a last accelerating electrode 35 which are sequentially installed from the screen electrode 33.

In the electron gun 30 configured as above, when a predetermined voltage is applied to the cathode structure 31 and the respective electrodes (32–35), thermions are emitted from the cathode structure 31 and simultaneously electron lenses are formed between the respective electrodes 32–35. Thus, the electron beam emitted from the cathode structure 31 is focused and accelerated as passing through the electron lenses formed between the respective electrodes.

In such an electron gun, a significant amount of the time required to emit the electron beam at a normal beam current density is taken up by the cathode structure. Thus, the cathode structure as a source for emitting electrons serves as an important factor in the electron gun.

The cathode structure is largely classified into an indirectly heated cathode in which thermions are emitted by heating electron-emitting material and a cold cathode in which electrons are emitted using an electrical field. In FIG. 3, an example of the cathode structure using a field emission array cell which is of the cold cathode type is illustrated.

As illustrated in the drawing, a cathode structure 40 includes a rimmed electrode member 41, an insulating member 42 inserted into the electrode member 41, a field emission array cell 44 disposed atop the insulating member 42, and pins 45 located at the insulating member 42 to supply power to the field emission array cell 44.

However, in the above-mentioned cathode structure 40, since a base member 44*a* of the field emission array cell 44 is attached to the upper surface of the insulating member 42, the field emission array cell 44 can be easily detached from the insulating member 42. That is, when the electron gun is heated at high temperature during a sealing or gas-exhausting step in a process of manufacturing the cathode ray tube, the strength of the attachment between the insulating member 42 and the base member 44*a* deteriorates due to the difference in the thermal expansion coefficients of the insulating member 42 and the base member 44*a*. Such deterioration of the attachment lessens the strength of attachment or vibration-proof property of the insulating member 42 and the base member 44*a* such that either member can be easily detached from the other by a small impact or vibrations.

SUMMARY OF THE INVENTION

To overcome the above problems, it is an objective of the present invention to provide a cathode structure in which the strength of attachment between the field emission array cell and the insulating member is improved, guaranteeing a stable structure, and an electron gun for a cathode ray tube using the same.

Accordingly, to achieve the above objective, there is provided A cathode structure comprising: an electrode member; an insulating member supported by the electrode member and having an indentation formed on the upper surface thereof; and a field emission array cell having a base member which is inserted into the indentation and attached thereto by an adhesive.

Also, to achieve the above objective, there is provided a cathode structure comprising: an electrode member; an insulating member supported by the electrode member; a field emission array cell having a base member which is installed on the upper surface of the insulating member; and a supporting member fixed to the insulating member for supporting the edge of the field emission array cell with respect to the upper surface of the insulating member.

Further, in the present invention, an electron gun for a color cathode ray tube including a cathode structure having three electrodes, a control electrode and a screen electrode, and a plurality of focus electrodes and last accelerating electrodes for forming electron lenses, the cathode structure comprising: a rimmed electrode member; an insulating member inserted into the electrode member and having an indentation formed on the upper surface thereof; a field emission array cell having a base member which is inserted into the indentation; and at least one supporting member installed at the insulating member for pressing down on the upper surface of the edge of the field emission array cell which is inserted into the indentation toward the upper surface of the insulating member.

BRIEF DESCRIPTION OF THE DRAWINGS

The above objective and advantages of the present invention will become more apparent by describing in detail a preferred embodiment thereof with reference to the attached drawings in which.

DETAILED DESCRIPTION OF THE INVENTION

Figure 1:
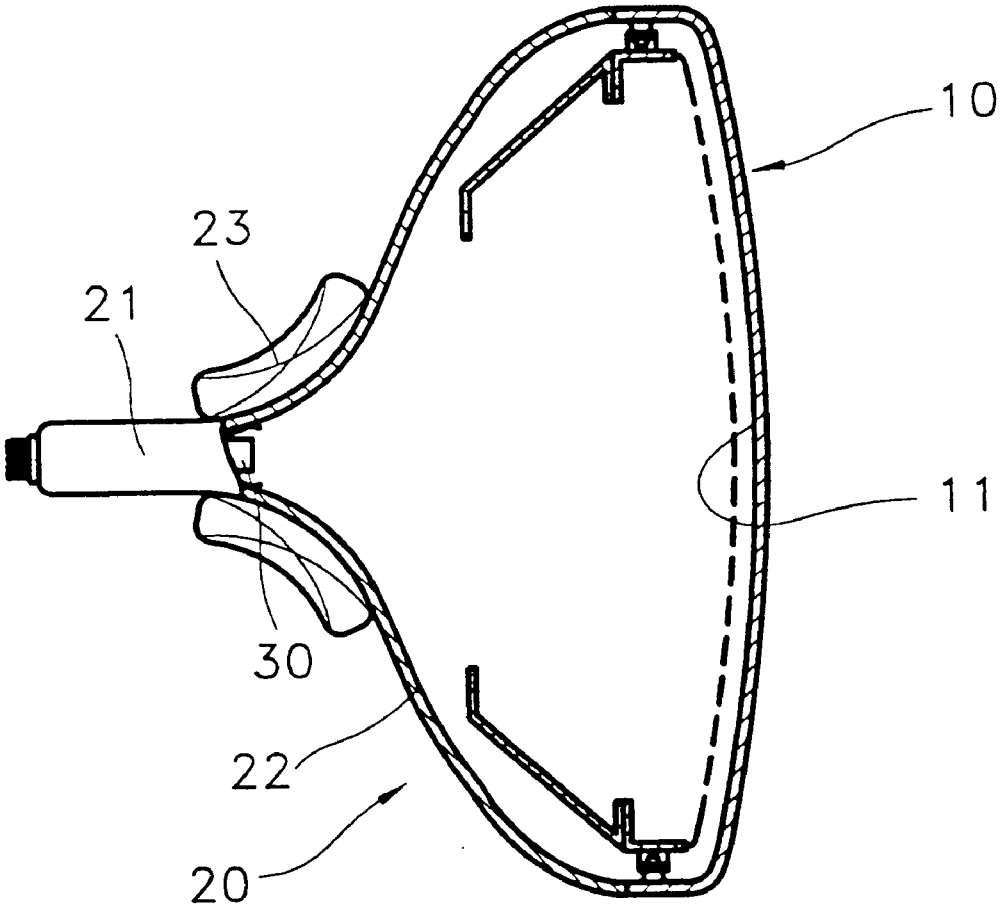
FIG. 1 (PRIOR ART)
FIG. 1 is a sectional view illustrating a typical cathode ray tube.
Figure 2:
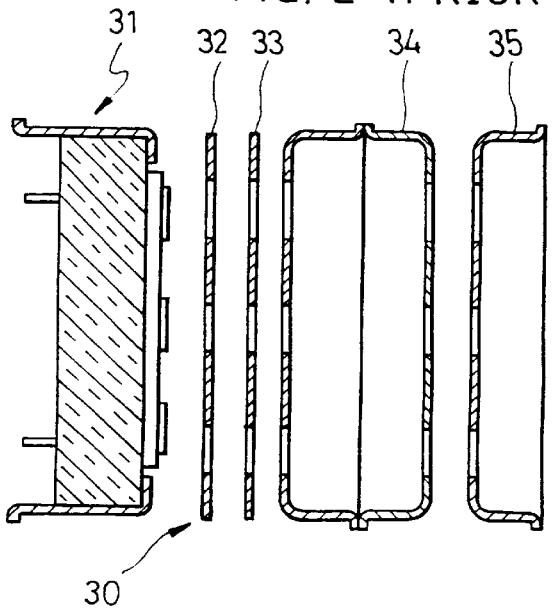
FIG. 2 (PRIOR ART)
FIG. 2 is a sectional view illustrating a conventional electron gun.
Figure 3:
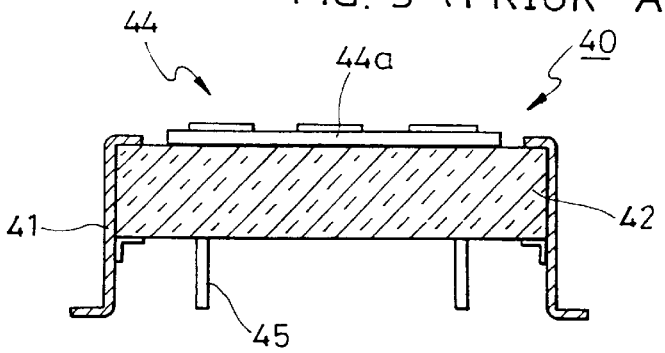
FIG. 3 (PRIOR ART)
FIG. 3 is a sectional view illustrating a conventional cathode structure.
Figure 4:
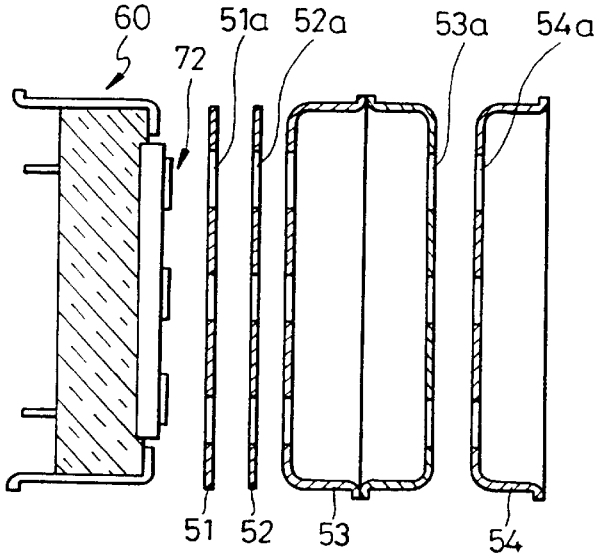
FIG. 4 is a sectional view illustrating an electron gun for a cathode ray tube according to the present invention.

Referring to FIG. 4, an electron gun according to an embodiment of the present invention includes a cathode structure 60 comprised of three electrode, a control electrode 51 and a screen electrode 52, and a focus electrode 53 and a last accelerating electrode 54 for forming electron lenses which are sequentially installed from the screen electrode 52. The cathode structure 60 has three in-line electron emitting portions 72 and each electrode 51-54 has three electron beam passing holes 51*a*, 52*a*, 53*a* and 54*a*. In the electron gun, a plurality of electron lenses for focusing and accelerating an electron beam can be formed by installing the focus electrode 53 in multiple numbers, and the control electrode 51 and the screen electrode 52 can be removed.

Figure 5:
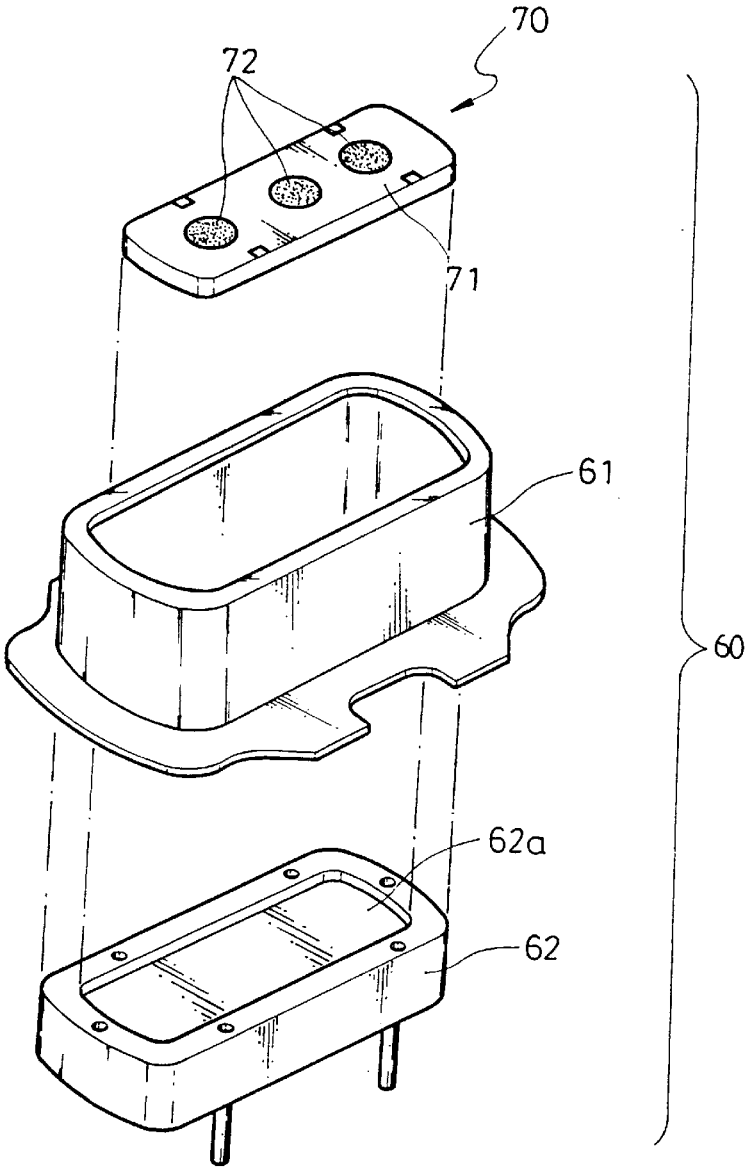
FIG. 5 is an exploded perspective view illustrating a cathode structure according to the present invention.
Figure 6:
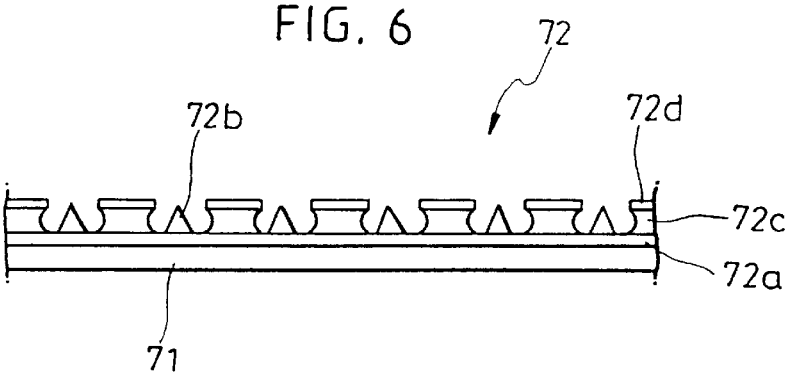
FIG. 6 is a sectional view illustrating a field emission array cell.

As shown in FIG. 5, the cathode structure 60 of the electron gun includes a rimmed electrode member 61 having an open upper surface and an insulating member 62, having an indentation 62*a* formed on the upper surface thereof, which is inserted into the electrode member 61 from the bottom. A field emission array cell 70 is inserted into the indentation 62*a* of the insulating member 62 and attached with an adhesive. Here, the field emission array cell 70 includes a base member 71 and an electron emitting portion 72 formed on the upper surface of the base member 71. Here, the respective electron emitting portions 72, as shown in FIG. 6, includes a cathode layer 72*a* formed on the upper surface of the base member 71 and a plurality of metal tips 72*b* installed a predetermined distance from each other on the upper surface of the cathode layer 72*a*. Since current of each metal tip 72*b* is between 50 nA–100 nA, current over 1 mA can be obtained with 10,000 or more metal tips, which is sufficient to excite the fluorescent film of the cathode ray tube.

Also, an insulating layer 72*c* and a gate layer 72*d* are formed to expose the metal tip 72*b* on the upper surface of the base member 71. The shape of the indentation 62*a* formed in the insulating member 62 is preferably formed befittingly to the shape of the base member 71 of the field emission array cell 70. Also, the depth of the indentation 62*a* of the insulating member 62 is preferably less than the thickness of the base member 71.

It is preferable that the base member 71 is attached to both the bottom surface and the side surface of the indentation 62*a*.

Figure 7:
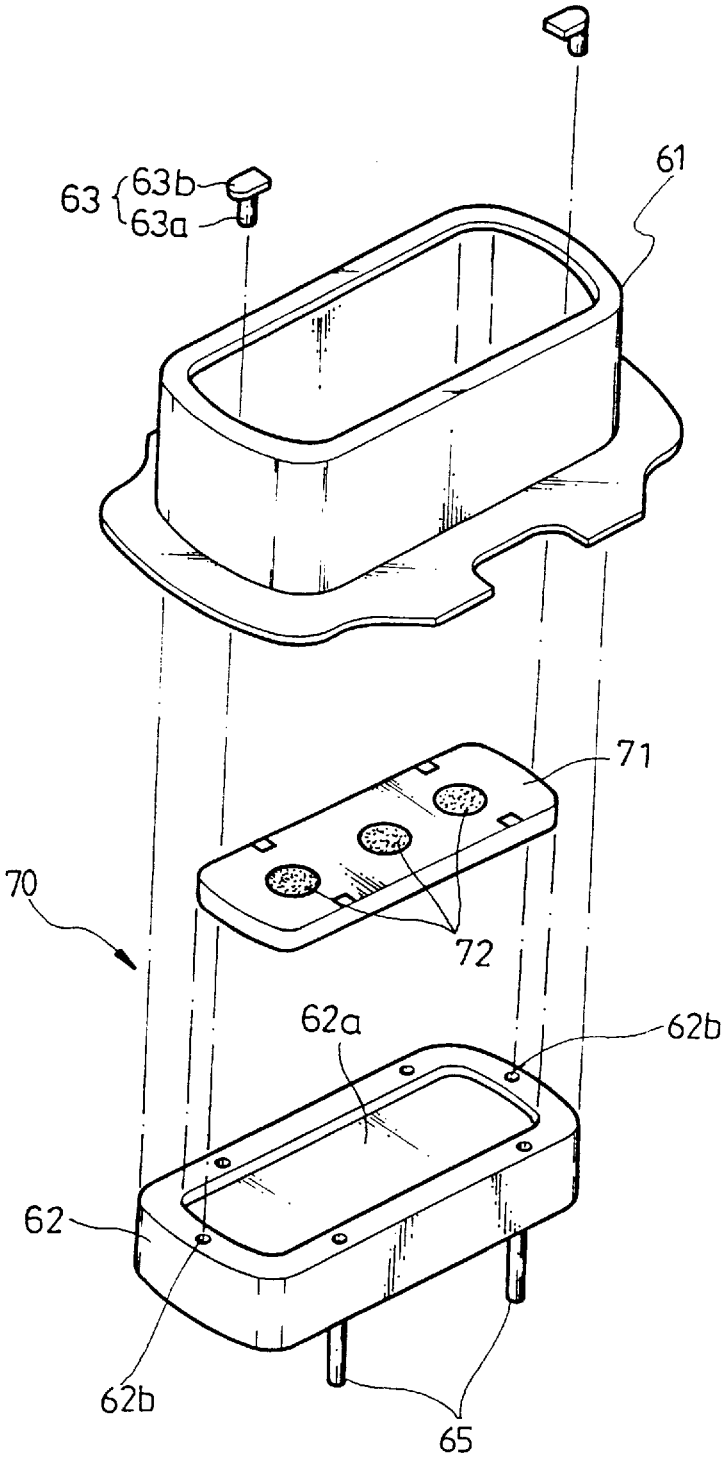
FIG. 7 is an exploded perspective view illustrating a cathode structure according to another embodiment of the present invention.

A cathode structure according to another embodiment of the present invention is shown in FIG. 7. Here, the same reference numerals indicate the same elements as those of the above-mentioned embodiment.

As shown in the drawing, an insulating member 62 is inserted into a rimmed electrode member 61 having an open upper surface, and a field emission array cell 70 having three electron emitting portions 72 arranged linearly and separated from each other by a predetermined distance is attached to the upper surface of the insulating member 62 using an adhesive. It is preferable that an indentation 62*a* to which the field emission array cell 70 is attached is formed on the upper surface of the insulating member 62, that the indentation 62*a* is formed in the same manner as that of the base member 71 of the field emission array cell 70 as described above, and that the depth of the indentation 62*a* is less than the thickness of the base member 71.

At least one supporting member 63 is installed at the upper surface of the insulating member 62 to support the base member 71 by pressing down on the edge of the base member 71 of the field emission array cell 70 against the indentation 62*a*. The supporting member 63 is comprised of a stem 63*a* which is inserted into a hole 62*b* formed on the edge of the upper surface of the insulating member 62 and an elastic piece 63*b* which extends from an end portion of the stem 63*a* toward the indentation 62*a* to elastically press down on the edge portion of the field emission array cell 70. A plurality of pins 65 for applying voltage to the field emission array cell 70 are installed on the insulating member 62.

The operations of the cathode structure having the above-described structure and an electron gun for a color cathode ray tube using the same will now be described with reference to FIGS. 1, 4, 5 and 6.

In a state in which the electron gun having the cathode structure according to the present invention is installed at the funnel neck portion 21 (see FIG. 1), when a predetermined electrical potential is applied to such respective electrodes constituting the electron gun as the control electrode 51 (see FIG. 4), the screen electrode 52, the focus electrode 53 and the last accelerating electrode 54, electron lenses are formed between the respective electrodes. When a predetermined voltage is applied to the metal tip 72*b* (see FIG. 6) of the field emission array cell 70 via the cathode layer 72*a*, an electron beam is emitted from the metal tip 72*b* to excite the fluorescent film.

As described earlier, the cathode structure for emitting an electron beam is heated in a sealing process or a gas-exhausting process of the electron gun. Although the strength of attachment between the lower surface of the base member 71 and the bottom surface of the indentation 62*a* weakens since the insulating member 62 and the base member 71 of the field emission array cell 70 move relative to each other due to the difference in the thermal expansion coefficients of the insulating member 62 and the base member 71 of the field emission array cell 70 during the above processes, the weakening of the attachment is prevented by the adhesive between the side surface of the base member 71 and the side surface of the indentation 62*a*. In particular, since the shape of the indentation 62*a* is formed to be the same as that of the base member 71 and the thermal expansion coefficient of the base member 71 is greater than that of the insulating member 62, the strength of attachment between the side surfaces of the base member 71 and the indentation 62*a* strengthens.

Also, the elastic piece 63*b* (see FIG. 7) of the supporting member 63 installed at the insulating member 62 supports the edge of the base member 71 so that separation of the field emission array cell 70 from the insulating member 62 can be prevented.

As described above, the cathode structure operating as above and the electron gun having the same have the following operational effects.

First, since thermions are emitted from the metal tip of the cathode structure concurrently with the application of a predetermined electric potential to the screen electrode of the electron gun, the time needed for normal emission of thermions from the cathode structure can be curtailed. Such saved time reduces the time for displaying an initial image on the cathode ray tube.

Second, since the field emission array cell is inserted into and attached by an adhesive to the indentation which is formed in the insulating member of the cathode structure, and the edge of the field emission array cell is supported by the supporting member fixed to the insulating member, deterioration of the attachment caused by a difference in the thermal expansion coefficients of the insulating member and the base member can be prevented.

Third, structural stabilization according to the attachment of the insulating member and the field emission array cell is improved.

It is noted that the present invention is not limited to the preferred embodiments described above, and it is apparent that variations and modifications by those skilled in the art can be effected within the spirit and scope of the present invention defined in the appended claims.

What is claimed is:

1. A cathode structure comprising:

an electrode member;

an insulating member supported by said electrode member and having an indentation formed on an upper surface thereof; and a field emission array cell having a base member which is inserted into said indentation and attached thereto by an adhesive.

2. A cathode structure as claimed in claim 1, wherein the shape of said indentation corresponds to the shape of said base member of said field emission array cell.

3. A cathode structure as claimed in claim 2, wherein the depth of said indentation is less than the thickness of said base member.

4. A cathode structure comprising:

an electrode member;

an insulating member supported by said electrode member;

a field emission array cell having a base member which is installed on an upper surface of said insulating member; and a supporting member fixed to said insulating member for supporting the edge of said field emission array cell with respect to the upper surface of said insulating member.

5. A cathode structure as claimed in claim 4, wherein an indentation in which said base member of said field emission array cell is placed is formed on the upper surface of said insulating member.

6. A cathode structure as claimed in claim 5, wherein the shape of said indentation corresponds to the shape of said base member of said field emission array cell.

7. A cathode structure as claimed in claim 4, wherein said base member of said field emission array cell is attached onto the upper surface of said insulating member by an adhesive.

8. A cathode structure as claimed in claim 4, wherein said supporting member is comprised of a stem fixed to said insulating member and an elastic portion extending from an end of said stem toward said indentation.

9. An electron gun for a color cathode ray tube including a cathode structure having three electrodes, a control electrode and a screen electrode, and a plurality of focus electrodes and an accelerating electrode for forming electron lenses, said cathode structure comprising:

a rimmed electrode member; an insulating member inserted into said electrode member and having an indentation formed on an upper surface thereof;

a field emission array cell having a base member which is inserted into said indentation; and a plurality of supporting members installed at said insulating member for pressing down on the upper surface of the edge of said field emission array cell which is inserted into said indentation toward the upper surface of said insulating member.

10. A cathode structure for a color cathode ray tube as claimed in claim 9, wherein said supporting member is comprised of a stem fixed to said insulating member and an elastic portion extending from an end of said stem toward said indentation to elastically press down on the edge of said field emission array cell.

* * * * *